US008505553B2

(12) United States Patent
Vandromme

(10) Patent No.: US 8,505,553 B2
(45) Date of Patent: Aug. 13, 2013

(54) APPLICATION INSTRUMENT OF SIMPLIFIED CONSTRUCTION

(75) Inventor: Michel Maurice Camille Vandromme, Le Plessis Brion (FR)

(73) Assignee: Yves Saint Laurent Parfums, Neuilly sur Seine (FR)

( * ) Notice: Subject to any disclaimer, the term of this patent is extended or adjusted under 35 U.S.C. 154(b) by 582 days.

(21) Appl. No.: 12/298,608

(22) PCT Filed: Apr. 27, 2007

(86) PCT No.: PCT/FR2007/000720

§ 371 (c)(1), (2), (4) Date: Apr. 27, 2009

(87) PCT Pub. No.: WO2007/125206

PCT Pub. Date: Nov. 8, 2007

(65) Prior Publication Data

US 2009/0320872 A1 Dec. 31, 2009

(30) Foreign Application Priority Data

Apr. 28, 2006 (FR) ..... 06 03867

(51) Int. Cl.
*A45D 40/26* (2006.01)
*A46B 3/18* (2006.01)

(52) U.S. Cl.
USPC ..... 132/218; 15/187; 15/206

(58) Field of Classification Search
USPC ..... 15/186–188, 206, 207.2, 225; 132/218, 132/320; 300/21
See application file for complete search history.

(56) References Cited

U.S. PATENT DOCUMENTS

| | | | | |
|---|---|---|---|---|
| 2,235,581 | A * | 3/1941 | King | 15/171 |
| 2,763,104 | A * | 9/1956 | Lindenborg | 451/469 |
| 3,998,235 | A * | 12/1976 | Kingsford | 132/218 |
| 5,951,185 | A | 9/1999 | Kingsford et al. | |

FOREIGN PATENT DOCUMENTS

| | | | |
|---|---|---|---|
| GB | 2259035 A | | 3/1993 |
| JP | 2003-38250 | * | 2/2003 |
| WO | 0158309 A1 | | 8/2001 |

OTHER PUBLICATIONS

Search Report for International Patent Application No. PCT/FR2007/000720; Nov. 22, 2007.

* cited by examiner

*Primary Examiner* — Mark Spisich
(74) *Attorney, Agent, or Firm* — Jason A. Bernstein; Barnes & Thornburg LLP

(57) ABSTRACT

An instrument (1) for applying a product such as mascara to epidermal derivatives, comprising an application means (4) for applying the product to the epidermal derivatives, wherein the instrument comprises a twisted plate (5) bearing the application means (4).

18 Claims, 2 Drawing Sheets

APPLICATION INSTRUMENT OF SIMPLIFIED CONSTRUCTION

PRIORITY CLAIM

This patent application is a U.S. National Phase of International Patent Application No. PCT/FR2007/000720, filed Apr. 27, 2007, which claims priority to French Patent Application No. 0603867, filed Apr. 28, 2006, the disclosures of which are incorporated herein by reference in their entirety.

FIELD

The present disclosure relates to devices for applying products, particularly cosmetic products, to an area of the human body preferably containing epidermal derivatives and, in particular, filiform and keratinized epidermal derivatives such as eyelashes.

The present disclosure relates more particularly to an instrument for applying a product to epidermal derivatives comprising a means of application of the product to epidermal derivatives.

The present disclosure also relates to a method of manufacturing of an instrument for applying a product to epidermal.

BACKGROUND

Mascara applicators in the form of brushes are already known. Such brushes typically comprise a gripping component, which may serve as a stopper for a container containing the mascara to be applied, together with a stem extending from the gripping component between a proximal end and a distal end.

A multitude of bristles extend radially from the stem at its distal end thus forming a means of application of mascara on eyelashes.

These prior art brushes are designed to be used as follows. The user dips the brush in a container containing mascara which has the effect of coating the bristles with mascara.

The user then performs an eyelash brushing action using the brush which has the effect of transferring the mascara from the bristles towards and onto the eyelashes, combing the eyelashes in the process.

Most of these prior art mascara brushes are obtained by positioning, between the two branches of a U-shaped metal pin, a series of independent fibers positioned roughly side by side with each other along the length of the interstitial space between the two branches of the pin. A torsional force is then applied on the pin which leads to its twisting. The twisting of the pin leads, in turn, to a trapping of the fibers between the branches and a helical expansion of the fibers, which adopt a distribution in helical layers. An application head which is fitted on the stem extending from the gripping component, in line with the stem, is thus obtained.

These prior art brushes present a number of drawbacks.

Firstly, their manufacturing method is relatively difficult to implement since the method is based on the association of a multitude of independent elements, namely the plurality of fibers and the U-shaped pin, which are furthermore very small in size and therefore difficult to handle.

In addition, the design of the prior art brushes and the difficult nature of their manufacturing means that it is impossible, using a given industrial tool, to vary significantly the shape and properties of the brushes manufactured, particularly from the point of view of the mechanical properties and the conformation of the bristles.

Lastly, given the industrial and design constraints referred to above, these prior art brushes allow the obtaining of a cosmetic result which is admittedly acceptable but far from remarkable.

SUMMARY

The present disclosure describes several exemplary embodiments of the present invention.

One aspect of the present disclosure provides an instrument for applying a product to epidermal derivatives, the instrument comprising a) means of application of said product to epidermal derivatives; and a twisted plate supporting said means of application.

Another aspect of the present disclosure provides a method of manufacturing an instrument for applying a product to epidermal derivatives, the method comprising producing an applicator for applying said product to epidermal derivatives, wherein the applicator comprises a) producing a plate; b) twisting the plate to obtain a twisted plate; and c) associating the applicator with the plate so that the twisted plate supports said applicator.

One feature of the present disclosure addresses the various drawbacks listed above and provides a new instrument for applying a product to epidermal derivatives which is of particularly simple and cheap construction and which allows an attractive cosmetic result to be obtained.

Another feature of the present disclosure provides an instrument for applying a product to epidermal derivatives which enables effective combing to be performed.

Another feature of the present disclosure provides an instrument for applying a product to epidermal derivatives which is of particularly simplified construction.

Another feature of the present disclosure provides an instrument for applying a product to epidermal derivatives of which the construction is based, in particular, on a general principle known and proven as such.

Another feature of the present disclosure provides an instrument for applying a product to epidermal derivatives of which the construction uses, in particular, standard parts used in the prior art.

Another feature of the present disclosure provides an instrument for applying a product to epidermal derivatives which, although of particularly simple and economical construction, provides an optimized cosmetic result with, in particular, the obtaining of a pleasant "feel" for the user.

Another feature of the present disclosure provides a method of manufacturing an instrument for applying a product to epidermal derivatives which is particularly simple, quick and inexpensive to implement.

Another feature of the present disclosure provides a method of manufacturing an instrument for applying a product to epidermal derivatives which is based on implementing a restricted number of steps which are very simple and quick to perform.

Another feature of the present disclosure provides a method of manufacturing an instrument for applying a product to epidermal derivatives which is based on a well-known and proven general principle.

Another feature of the present disclosure provides a method of manufacturing an instrument for applying a product to epidermal derivatives which allows the obtaining of an instrument allowing optimized application of make-up using, in particular, standard parts known in the prior art.

BRIEF DESCRIPTION OF THE DRAWINGS

Various aspects of the present disclosure are described hereinbelow with reference to the accompanying figures.

Other advantages and features of the invention will appear in greater detail on reading the description hereinbelow in conjunction with the drawings which are supplied purely for explanation and are not limiting, in which.

DETAILED DESCRIPTION

Figure 1:
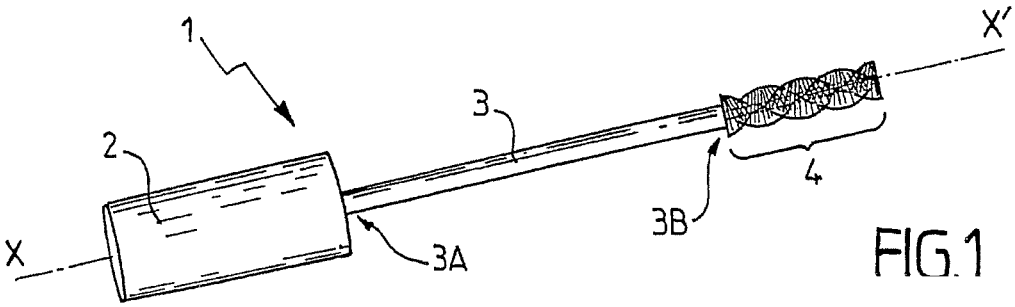
FIG. 1 is a side view of an instrument according to one exemplary embodiment of the present disclosure designed for applying mascara on eyelashes.

The present disclosure relates to an instrument 1 for applying a product, preferably liquid, semi-liquid (for example, pasty) or powdery, to epidermal derivatives and, in particular, to fibrous keratinic epidermal derivatives such as bodily hairs (for example, eyelashes, eyebrows, beard and moustache) or hair on the head.

Advantageously, the product to be applied is a cosmetic product with the result that the instrument 1 constitutes, in this case, a cosmetic instrument.

Preferentially, the product to be applied is mascara for eyelashes. The instrument 1 then constituting a mascara applicator for eyelashes.

For reasons of simplicity of description, the following text refers, as an example, exclusively to such a mascara applicator. The invention is not, however, limited to the applying of a product necessarily of a cosmetic nature nor to the applying of a product necessarily of the same consistency as mascara. The instrument 1 may be used to apply any product, whatever its consistency. The product may, for example, be very fluid or, on the contrary, be very viscous and/or pasty; or the product take the form of a powder.

In a manner known per se, the instrument 1 comprises a gripping component 2 designed to be gripped and manipulated manually by a user, for example, between two or three fingers. The instrument 1 is, therefore, typically of a portable nature and is intended for manual use. Preferentially, the gripping component 2 may also be shaped to serve as a stopper for a container (not shown) containing a stock of product to be applied, which is preferably mascara for eyelashes. Such an arrangement is standard and will not, therefore, be described in detail below.

Preferably, the instrument 1 comprises a stem 3 extending roughly in a straight line in an axial direction X-X' from the gripping component 2 between a proximal end 3A and a distal end 3B.

In accordance with the present disclosure, the instrument 1 comprises a means of application 4 of the product to be applied to epidermal derivatives. The means of application 4 is preferentially designed to collect the product to be applied (for example, mascara) and apply the product to epidermal derivatives (for example, eyelashes).

In the example illustrated in the figures, the means of application 4 is preferentially and specifically designed to pick up the product to be applied, for example, by being immersed in a reserve of this product, and to retain and contain this quantity of product picked up until its release on the epidermal derivatives. This is preferably performed by placing in contact and rubbing of the means of application 4 with and against the epidermal derivatives.

In the exemplary embodiments illustrated in the figures in which the instrument 1 constitutes a mascara applicator for eyelashes, and more precisely a mascara brush, the means of application 4 also allows, simultaneously with the coating of the eyelashes with mascara, the performing of an eyelash combing and separating function. For this purpose, the means of application 4 preferentially comprises a plurality of protuberances 4A which thus advantageously form combing teeth, that is to say brush bristles which enable the eyelashes to be coated with mascara while at the same time the eyelashes are combed. Naturally, the present disclosure is not limited to a particular structure of the means of application 4, this structure being essentially dictated by the consistency of the product to be applied, the nature of the receiving support (for example, eyelashes or fingernails), and the required make-up quality.

According to the present disclosure, the instrument 1 comprises a twisted plate 5 supporting the means of application 4. For purposes of the present disclosure, the term "plate" means a sheet of flexible or rigid material, the thickness of which is relatively small compared to its area. In the examples illustrated in the figures, the plate 5 presents, for example, a thickness roughly between 0.05 and 2 mm, the thickness preferentially being between 0.1 and 1 mm, and even more preferentially roughly equal to 0.2 mm.

As specified above, the plate 5 supports the means of application 4, that is to say the plate 5 serves as a support for the means of application 4. In other words, the means of application 4 is attached to the plate 5, that is to say means of application 4 is mounted on the plate 5. Preferably, as illustrated in the figures, the means of application 4 is one with the plate 5, that is to say the means of application 4 forms with the plate 5 a single one-piece part. However, the means of application 4 may be distinct and independent from the plate 5 and be attached on the plate 5 by any appropriate means, for example, by gluing, flocking, heat-sealing, crimping or mechanical assembly, without this constituting a departure from the present disclosure.

As has been mentioned above, the plate 5 is twisted, that is to say the plate 5 is bent helically in a spiral, preferably along the axis corresponding to its length. The plate 5 is thus corkscrew-shaped, that is to say twisted and wound on itself. Given that the plate 5 supports the means of application 4, the twisted nature of the plate 5 enables generation of an "expansion" of the means of application 4, that is to say in this instance a helical or spiral distribution around the axis X-X' of the means of application 4.

The general principle which underlies the present disclosure is therefore based on the idea of using a plate to control the spatial distribution of the means of application whereas, in the prior art, action was taken directly on the means of application, which was a source of difficulties, notably of a technical and industrial nature.

Hereinbelow, the exemplary embodiments illustrated in FIGS. 1-6 will be described in greater detail.

In the following exemplary embodiments, the plate 5 is of a slender, elongated nature, that is to say the plate 5 extends mainly in a single direction in space, in this instance, the axial direction X-X'. The plate 5 is, in the exemplary embodiments, advantageously twisted in its main axis of extension, that is to say the axis X-X'.

Figure 4:
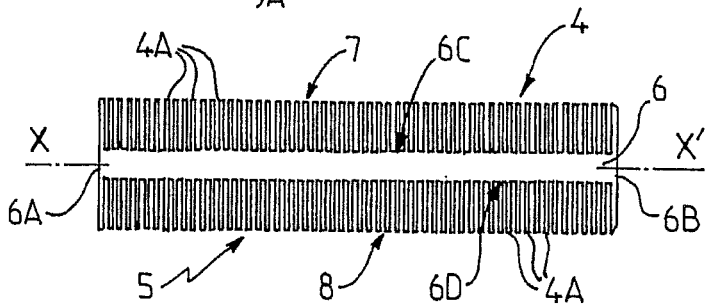
FIG. 4 is a front view of the untwisted plate used in the construction of the instrument shown in FIGS. 1-3.
Figure 5:
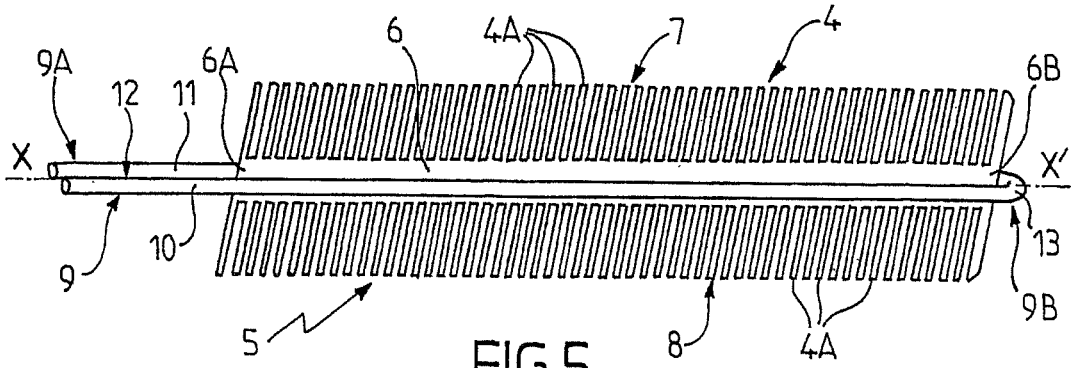
FIG. 5 is a perspective view of the cooperation of the plate shown in FIG. 4 and the core shown in FIG. 3, before the plate and core are twisted.
Figure 6:
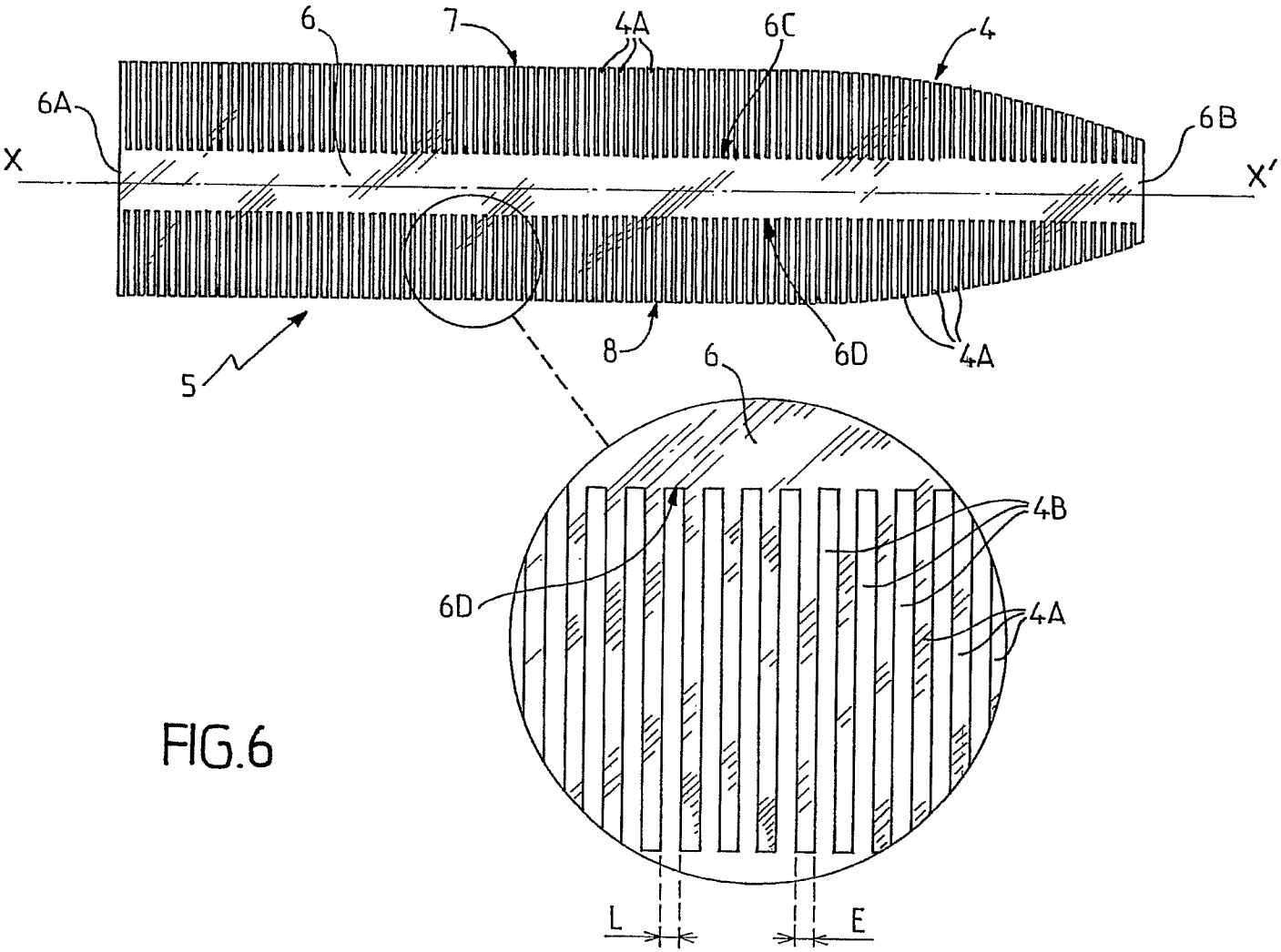
FIG. 6 is a front view of a second exemplary embodiment of a plate used in the construction of an instrument according to the present disclosure before the plate is twisted.

Advantageously, as can be seen particularly in FIGS. 4-6, the plate 5 comprises a central panel 6 extending both in the longitudinal direction, corresponding to the direction of the axis X-X', between a first end and a second end 6A, 6B, and in the transverse direction, which is, in this instance, perpendicular to the axis X-X' between a first edge and a second edge 6C, 6D. In the exemplary embodiments illustrated in the figures, the panel 6 is initially untwisted, as can be seen in FIGS. 4-6. Advantageously, the central panel 6 takes in this initial untwisted state the form of a flat rectangular strip with two long straight sides parallel to the axis X-X' corresponding to the first and second edges 6C, 6D and two short sides parallel to each other and perpendicular to the axial direction X-X' corresponding to the first and second ends 6A, 6B respectively. Advantageously, a first and second series 7, 8 of protuberances 4A protrude from the first and second edges 6C, 6D of the central panel 6, respectively.

When the central panel 6 is in its initial untwisted state, illustrated in FIGS. 4-6, the protuberances 4A extend in the plane of the as yet untwisted central panel 6 perpendicular to the axis X-X', that is to say in the transverse direction. The protuberances 4A, which preferentially, as illustrated, take the form of straight, elongated plane-parallel blades, are positioned regularly along the whole length of the first and second edges 6C, 6D, perpendicular to these edges. The first and second series 7, 8 of protuberances 4A are thus advantageously symmetrical with respect to the median plane of the central panel 6 parallel to the axis X-X'.

In the example illustrated in FIG. 4, the blades forming the protuberances 4A are all identical, whereas in the example illustrated in FIG. 6, the length of the blades progressively decreases near the second end 6B of the central panel 6 in the direction from the first end 6A to the second end 6B. This oblique profile enables a "pointed" brush profile facilitating making-up of the corner of the eye.

The first and second series 7, 8 of protuberances 4A contribute, as described above, to forming the means of application 4. More precisely, in the examples illustrated in the figures, the means of application 4 is formed by the two series 7, 8 of protuberances 4A.

Thus, prior to the twisting of the central panel 6, the plate 5 and the means of application 4 take the form of a single flat one-piece part with a nucleus formed by a flat strip constituted by the central panel 6 and protuberances extending laterally in the transverse direction perpendicular to the axis X-X' from each edge 6C, 6D in the plane of the central panel 6.

Figure 2:
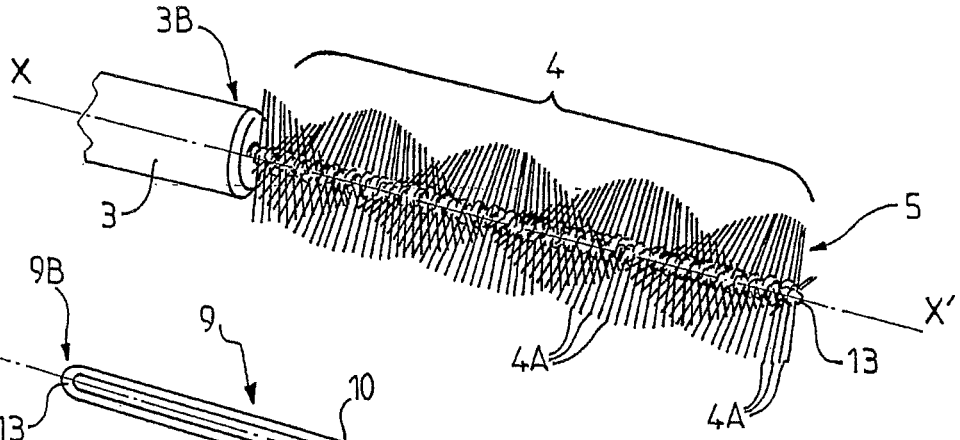
FIG. 2 is a perspective view of a detail of production of the instrument shown in FIG. 1.

In order to obtain the twisted plate supporting the means of application according to the present disclosure, the central panel 6 is twisted in the longitudinal direction defined by the axis X-X', which leads to the forming of helical layers of protuberances 4A as can be seen in FIGS. 1 and 2.

The twisting of the central panel 6 thus generates a spiral distribution of the protuberances 4A around and along the axis X-X'. This twisting is advantageously obtained by subjecting the initially untwisted central panel 6 to a torsional force produced, for example, by applying a movement of rotation around the axis X-X' on one of its parts (for example, in the clockwise direction) while the other parts remain fixed or are subjected to a movement in the opposite direction (for example, counterclockwise).

This torsional force is maintained resulting in plate 5 adopting its twisted shape in a stable and permanent manner. It is also feasible, if the torsional force is not maintained, for this force to be sufficient to impart a stable plastic deformation to the central panel 6 with the result that the panel adopts a twisted shape in a stable and permanent manner.

Alternatively, it is also feasible to obtain a plate 5 twisted by construction, without any twisting step, for example, by molding in a mold having a twisted shape.

We have seen hereinabove that the means of application 4 advantageously comprises a plurality of protuberances 4A extending from the plate 5, and that the means of application 4 is preferably one with the plate 5.

Particularly preferentially, the means of application 4 is cut out in the plate 5. In other words, the means of application 4 and the plate 5 are formed by a one-piece part from which the means of application 4 is formed by removal of material. Preferably, notches 4B are made in the plate 5 to form the protuberances 4A.

Thus, in the example illustrated in FIG. 4, the protuberances 4A of the first and second series 7, 8 and the central panel 6 are obtained by cutting a flat strip of material presenting a roughly rectangular form, the long sides of the flat strip having regularly spaced transverse notches to obtain the part illustrated in FIG. 4, which comprises a central panel 6 from which two opposing rows of teeth constituted by the first and second series 7, 8 of protuberances 4A extend laterally. The part illustrated in FIG. 4 is then twisted along the axis X-X', as explained hereinabove.

This twisted plate 5 supporting the means of application 4 is lastly attached by any appropriate means (crimping or gluing, for example) to the stem 3 near the distal end 3B of this stem, as illustrated in FIGS. 1 and 2. The twisted plate 5 supporting a means of application 4 thus forms an application head for the instrument 1 extending from the distal end 3B roughly in line with the stem 3 along the axis X-X'.

Advantageously, the instrument 1 according to the present disclosure comprises a supporting core 9 to which the plate 5 is attached. The core 9 extends preferentially in a straight line along the axis X-X' between a first end 9A which is preferentially connected to the distal end 3B of the stem 3 and a second free end 9B.

It is also feasible for the core 9 not to extend strictly in a straight line, as illustrated in the figures, but alternatively to present a slightly curved shape (not shown) instead, for example, corresponding to the average profile of implantation of the eyelashes. In this case, as will be understood subsequently, the axial direction X-X' is not defined by a straight line but by a curved line which follows the axis of extension of the core 9.

In the examples illustrated in the figures, the core 9 is distinct from the stem 3 and is attached to the stem 3, for example, by crimping. It is, however, quite feasible for the core 9 to be directly formed by the stem 3 itself. It also feasible for the instrument 1 not to include the stem 3, the core 9 being directly connected to the gripping component 2. It is also possible for the core 9, and more particularly its first end 9A, to be shaped to directly constitute the gripping component 2 by itself, without departing from the scope of the present disclosure.

As has been mentioned hereinabove, the plate 5 is attached to the supporting core 9, that is to say the plate 5 and the supporting core 9 are mechanically connected.

Advantageously, the supporting core 9 is itself twisted, and even more preferentially the plate 5 is flexible and the twisted nature of the plate 5 is imparted by the core 9 which is itself twisted. In other words, the core 9 is advantageously designed to maintain a torsional force at all times on the plate 6, the torsional force maintaining the plate 5 in a twisted, spiralled state, as illustrated in FIG. 2.

Figure 3:
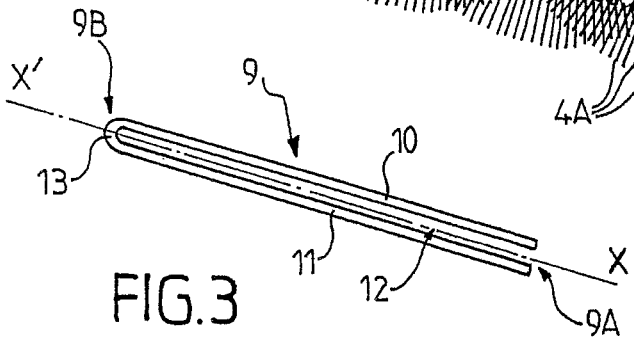
FIG. 3 is a schematic front view of a U-shaped pin forming the core of the instrument shown in FIGS. 1 and 2 before the pin is twisted.

To this end, the core 9 preferably comprises two elongated branches 10, 11 extending longitudinally in two roughly parallel directions of extension delimiting between them an interstitial space 12 in which the plate 5 is inserted, as illustrated in FIGS. 2 and 5. In the exemplary embodiment illustrated in the figures, the elongated branches 10, 11 are initially roughly straight, rectilinear and parallel to each other, as illustrated in FIGS. 3 and 5, while plate 5 is initially untwisted and flat when it is slid between the branches 10, 11, themselves not yet twisted. A torsional force is then applied on the core 9 in the axis X-X' which is parallel to the branches 10, 11 and passes through the middle of the interstitial space 12. This torsional force is exerted simultaneously on the two elongated branches 10, 11, which leads to a twisting of the core 9 in a double helix around the axis X-X, each helix corresponding to one of the branches 10, 11. The twisting of the core 9 leads simultaneously to the capture of the plate between the branches 10, 11 and the twisting of the plate, which goes from the configuration illustrated in FIG. 5 to the configuration illustrated in FIGS. 1 and 2.

Advantageously, the core 9 comprises a U-shaped pin. The arms of the U-shaped pin are twisted and form the two elongated branches 10, 11, the branches of the U-shaped pin being linked by a crosspiece 13 which advantageously presents a curved shape and extends in line with the branches 10, 11.

Preferentially, the U-shaped pin is made of a metallic material, such as stainless steel, so that the twisting of the pin leads to a permanent plastic deformation, according to a spiral profile around the axis X-X', of the elongated branches 10, 11.

The plate 5, for its part, is preferentially produced from a flexible, deformable material and, for example, from an elastomer material such as polytetrafluoroethylene (PTFE).

The use of such a material improves the contact properties of the instrument, favoring a soft "feel".

Hereinabove, we have described exemplary embodiments using a single plate 5, although it is quite feasible for the instrument 1 to comprise several distinct and independent twisted plates 5. It is possible for the plates to be different from the point of view both of material and of geometry without departing from the scope of the present disclosure.

Hereinabove, we have described the use of a plate 5 and a core 9 which are distinct and independent, although it is quite feasible for the core 9 to be one with the plate 5 with the result that the plate 5 and the core 9 form a single one-piece part.

The present disclosure also relates to a method of manufacturing of an instrument 1 for applying a product to epidermal derivatives and, in particular, of an instrument 1 in accordance with that which has been described hereinabove.

Preferably, the method according to the present disclosure constitutes a method for manufacturing a mascara applicator for eyelashes.

The method according to one exemplary embodiment of the present disclosure comprises a step (a) of production of a means of application 4 of the product to be applied to epidermal derivatives.

The method according to the present disclosure also comprises:

- a step (b) of producing or supplying a plate 5;
- a step (c) of twisting the plate 5 to obtain a twisted plate; and
- a step (d) of associating the means of application 4 with the plate 5 so that the twisted plate 5 supports the means of application 4.

As has been seen above, step (c) is advantageously subsequent to step (d), that is to say, the twisting of the plate is carried out after the means of application 4 has been attached to the as yet untwisted plate 5, with the result that the twisting of the plate 5 leads to the expansion of the means of application.

Advantageously, step (c) is subsequent to step (b), that is to say, the plate resulting from step (b) is not already twisted by construction, the manufacturing of the plate 5 and its twisting being carried out by distinct, independent operations at different times.

Advantageously, as it has been described hereinabove, steps (a) and (d) are simultaneous, that is to say, the production of the means of application 4 is concomitant with, and even preferentially performed in the same operation as, the association of the means of application with the plate 5. In other words, the production of the means of application 4 simultaneously leads to the association of the means of application 4 with the plate 5 and vice versa.

This simultaneity may, of course, be obtained when the means of application 4 is one with the plate 5, as described hereinabove. In this case, and advantageously, steps (a) and (d) comprise an operation of cutting (d') of the means of application 4 in the plate 5 obtained following step (b). For example, the plate obtained following step (b) takes the form of a roughly plane-parallel solid flat sheet.

Preferentially, in the course of the cutting operation (d'), a series of notches is made in this plate to form a plurality of protuberances on the outer edge of the plate, the protuberances forming the means of application 4. In other words, the plate obtained following step (b), which was initially uniform and continuous, is now fringed following step (d'), the fringes corresponding to the series 7, 8 of protuberances 4A.

We thus obtain, following the cutting operation (d'), a basically flat part similar to that illustrated in FIGS. 4 and 6.

Preferentially, the cutting operation (d') is performed by means of a laser beam which allows rapid, precise and economical production of the delicate architecture of the fringed part illustrated in FIGS. 4 and 6. As an example, the width E of each fringe forming a protuberance 4A is roughly between 0.05 and 2 mm, and is preferably roughly between 0.1 and 0.5 mm, a width E roughly equal to 0.2 mm being particularly preferred. The inter-fringe space, corresponding to the notches 4B, advantageously presents a width L roughly between 0.01 and 2 mm, preferably roughly between 0.05 and 0.2 mm, a width L roughly equal to 0.1 mm being particularly preferred.

Preferentially, the plate obtained following step (b) is obtained from a cutting operation by means of a laser beam.

Naturally, the use of a laser to perform the hereinabove-mentioned cutting operations is purely optional. It is possible to perform these cutting operations by any other means and, in particular, by using mechanical means such as a cutting die.

Thus, particularly advantageously, steps (a), (b) and (d) are performed by means of a single cutting operation, preferably performed using a laser beam, enabling the part illustrated in FIG. 4 or the part illustrated in FIG. 6 to be produced by cutting in a panel of material.

Advantageously, the method described hereinabove further comprises a step (e) of manufacturing or supply a supporting core 9. For example, in the course of step (e), a core 9 comprising two elongated branches 10, 11 delimiting between them an interstitial space 12 is manufactured or supplied. Preferably, in the course of step (e), a core 9 comprising a U-shaped pin, the arms of the U forming the two elongated branches 10, 11, is manufactured or supplied.

The U-shaped pin, which is preferably produced by simple bending of a straight, one-piece metal wire, is sometimes referred to as a "stirrup".

Advantageously, the method according to the present disclosure comprises a step (f) in the course of which the part obtained following step (b) is attached to the supporting core 9 with the result that a twisting of the core 9 generates a twisting of the plate 5. In other words, the mechanical link between the core 9 and the plate 5 is chosen so that a torsional deformation of the core 9 (twisting of the core 9) causes a torsional deformation of the plate 5 (twisting of the plate 5) leading to a corkscrew twisting of the plate 5 along the axis X-X'.

Advantageously, in the course of step (f), the plate 5 is inserted in the interstitial space 12 corresponding to the air gap of the U-shaped pin forming the core 9.

Preferably, steps (e) and (f) are thus subsequent to step (b) and prior to step (c).

As has been explained hereinabove, in the course of step (c), twisting of the core 9 is carried out to twist the plate 5.

Preferentially, in the course of step (c), the core 9 is twisted along an axis X-X' parallel to the two elongated branches 10, 11, the axis is at an equal distance from the two branches 10, 11.

Thus, in its most advantageous exemplary embodiment, the present disclosure enables the obtaining of a mascara brush presenting an expansion of the protuberances forming bristles, enabling, in particular, optimizing the eyelash combing and curling effect by simple implementation of the following steps:

insertion of a flexible plate supporting bristles in the air gap of a stirrup; and twisting the stirrup in such a way as to generate twisting of the plate with the result that the bristles, initially distributed in the form of straight rows, now extend in the form of helical rows turning in a spiral around the axis X-X' as illustrated in FIG. 2.

It is also feasible, without departing from the scope of the present disclosure, to insert free fibers in addition to the plate 5 in the air gap of the U-shaped pin.

Thus during the U-shaped pin twisting step, the fibers will also be subjected to a helical movement leading to their expansion. We thus obtain a "mixed" application head comprising both protuberances 4A from the plate 5 and free fibers (not shown). It is also feasible, following the plate 5 twisting step, preferably performed by twisting of the core 9, for the general profile of the means of application 4 formed by the plurality of protuberances 4A to be modified by machining, that is to say by removal of material in the spiral layers formed by the protuberances 4A.

The invention claimed is:

1. An instrument for applying mascara to eyelashes or other epidermal derivatives, the instrument comprising:

a) means of application of the mascara to epidermal derivatives;

b) a twisted plate supporting the means of application, the twisted nature of the plate enabling the generating of a helical spaced apart distribution of the means of application; and, c) a supporting core to which the plate is attached, the supporting core being twisted, wherein the means of application is adapted to releasably hold a quantity of mascara and, as a user combs the means of application through the eyelashes or other epidermal derivatives, release the mascara so as to at least partially coat the eyelashes or other epidermal derivatives.

2. The instrument of claim 1, wherein the means of application comprises a plurality of protuberances extending from the plate.

3. The instrument of claim 2, wherein notches are made in the plate to form the protuberances.

4. The instrument of claim 1, wherein the means of application is one with said plate.

5. The instrument of claim 4, wherein the means of application is cut in said plate.

6. The instrument of claim 1, wherein the plate comprises a central panel extending both in the longitudinal direction, between a first end and a second end, and in the transverse direction, between a first edge and a second edge, a first and second series of protuberances protruding from the first and second edges respectively, said first and second series of protuberances contributing to forming said means of application, said central panel being twisted in the longitudinal direction.

7. The instrument of claim 1, wherein said plate is flexible and wherein the twisted nature of the plate is imparted by the core.

8. The instrument of claim 1, wherein the core comprises two elongated branches delimiting between them an interstitial space in which said plate is inserted.

9. The instrument of claim 8, wherein the core comprises a U-shaped pin, the arms of the U being twisted and forming the two elongated branches.

10. The instrument of claim 1, wherein the plate is made from an elastomer material.

11. The instrument of claim 1, wherein the means for application comprises a plurality of protuberances extending from the plate in a generally parallel and nonoverlapping direction when in a twisted configuration.

12. The instrument of claim 1, wherein the means for application comprises a plurality of protuberances alternating with notches to provide a space between adjacent protuberances.

13. The instrument of claim 1, wherein the means for application comprises a plurality of protuberances extending from the plate in a generally expanded and nonoverlapping direction when in a twisted configuration.

14. An instrument for applying mascara or other material to epidermal derivatives, such as eyelashes, the instrument comprising:

a) a gripping element;

b) a stem extending from an end of the gripping element;

c) an elongated U-shaped core element extending from an end of the stem opposite the gripping element, the core element having a crosspiece from which extend first and second branches having a gap defined therebetween;

d) a plate fitted within the gap of the core element and comprising i) a central panel formed as a generally flat sheet having a first and second elongated sides and first and second ends, ii) a plurality of protuberances extending from the first and second elongated sides, wherein the core element and plate are in a twisted configuration to provide a helical distribution of the protuberances.

15. The instrument of claim 14, wherein the instrument further comprises a plurality of fibers inserted into the gap of the core element.

16. The instrument of claim 14, wherein the instrument further comprises at least one second plate fitted within the gap of the core element, each second plate comprising a central panel formed as a generally flat sheet having a first and second elongated sides and first and second ends and a plurality of protuberances extending from the first and second elongated sides.

17. An instrument for applying mascara or other material to epidermal derivatives, such as eyelashes, the instrument comprising:

a) a gripping element;

b) a stem extending from an end of the gripping element;

c) an applicator presented as a helical shape and associated with the stem, the applicator comprising a elongated core element extending from an end of the stem opposite the gripping element and having a crosspiece from which extend first and second branches having a gap defined therebetween, the applicator further comprising a plate having an elongated central panel having first and second sides and having protuberances extending from the first and second sides, the plate being fitted within the gap and wherein the plate and first and second branches are twisted such that the protuberances form a generally helical shape.

18. An instrument for applying mascara to eyelashes or other epidermal derivatives, the instrument comprising:

a) means for releasable retention and subsequent application of the mascara to epidermal derivatives;

b) a support means providing a plastically deformed twisted portion for supporting the means of application; and, c) a core providing a twisted portion to which the support means is attached, the support means twisted portion and the core twisted portion providing a spaced apart helical distribution of the means of application, wherein the means of application is adapted to releasably hold a quantity of mascara and, as a user combs the means of application through the eyelashes or other epidermal derivatives, release the mascara so as to at least partially coat the eyelashes or other epidermal derivatives.

* * * * *